US005123597A

United States Patent [19]

Bendall

[11] Patent Number: 5,123,597

[45] Date of Patent: Jun. 23, 1992

[54] SPRINKLER NOZZLE WITH VENT PORT

[75] Inventor: Albert R. Bendall, San Diego, Calif.

[73] Assignee: Hunter Industries, San Marcos, Calif.

[21] Appl. No.: 674,535

[22] Filed: Mar. 21, 1991

[51] Int. Cl.[5] ..... B05B 3/04; B05B 3/16

[52] U.S. Cl. ..... 239/124; 239/205; 239/206; 239/246

[58] Field of Search ..... 239/124, 204–206, 239/231, 237, 240–242, 246

[56] References Cited

U.S. PATENT DOCUMENTS

| | | | |
|---|---|---|---|
| 2,009,478 | 7/1935 | Coles et al. | 239/246 |
| 3,794,245 | 2/1974 | Wilson | 239/206 |
| 3,924,809 | 12/1975 | Troup | 239/246 |
| 4,568,024 | 2/1986 | Hunter | 239/242 |
| 4,625,914 | 12/1986 | Sexton et al. | 239/242 |
| 4,681,259 | 7/1987 | Troup et al. | 239/206 |
| 4,796,809 | 1/1989 | Hunter | 239/205 |
| 4,834,289 | 5/1989 | Hunter | 239/205 |
| 4,836,450 | 6/1989 | Hunter | 239/242 |

*Primary Examiner*—Andres Kashnikow
*Assistant Examiner*—Karen B. Merritt
*Attorney, Agent, or Firm*—Baker, Maxham, Jester & Meador

[57] ABSTRACT

A sprinkler nozzle for distributing water from a source over an area of terrain comprising a body defining a passage having an inlet section connected by a curve to an outlet section extending at an angle to the inlet section, and a vent port in the passageway at the inside of the curve communicating with an annular chamber surrounding the inlet section for enhancing the reach of the nozzle.

19 Claims, 2 Drawing Sheets

SPRINKLER NOZZLE WITH VENT PORT

BACKGROUND OF THE INVENTION

The present invention relates to sprinkler units and pertains particularly to an improved sprinkler nozzle having improved range of the water stream.

The artificial distribution of water through irrigation systems is in wide use throughout the world today. There are many irrigation systems utilized, with each having its benefits and drawbacks.

One of the most widely used systems, particularly where water is not abundant or plentiful, is the sprinkler system wherein a plurality of nozzles are distributed about an area for distributing water over the surface of the land area. Such systems are widely used for lawns, golf courses, playing fields and many field crops.

The ideal sprinkler irrigation system would utilize a minimum number of nozzles to achieve a substantially uniform distribution of water over a maximum area. This approach presents a major problem since the optimum reach, or distance to which a given volume of water is thrown, of a sprinkler unit is inconsistent with optimum distribution. Optimum reach of a sprinkler unit is achieved by maintaining a coherent or homogenous water stream. A coherent or homogenous stream would distribute most of the water at the outermost end of its reach.

One approach is disclosed in U.S. Pat. No. 4,796,809, granted Jan. 10, 1989 to Edwin J. Hunter.

In order to obtain a coherent or homogenous water stream, turbulence must be eliminated at the nozzle outlet. The majority of turbulence at the nozzle outlet is caused by curves in the water passage near the outlet for directing the vertical flow from the vertical riser to the horizontal direction of the outlet. This turbulence can be largely eliminated with large diameter units by providing a long straight passage from the curve of the passage to the outlet. However, this approach is not possible with small diameter sprinkler units.

For a rotating stream sprinkler unit having a coherent stream, the majority of the water would be distributed in a circular path at the outermost reach of the stream, forming a circle surrounding the sprinkler unit. In order to cover the area inside the circle toward the center of axis of rotation, it is necessary to disrupt the stream to cause deflection of a portion of the stream over the inner area. Many attempts have been made in the past to provide an optimum mechanism for achieving an optimum distribution of water over the area. While many of these attempts have proven to be somewhat effective, they have not been entirely satisfactory.

Accordingly, it is desirable that a sprinkler nozzle be available for providing optimum reach for a given stream of water from a sprinkler unit to provide optimum water coverage.

SUMMARY AND OBJECTS OF THE INVENTION

Accordingly, it is a primary object of the present invention to provide a sprinkler unit having means for achieving an optimum stream reach.

In accordance with the primary aspect of the present invention, a sprinkler unit comprises a continuously rotating nozzle, with venting means for venting the nozzle and increasing the reach thereof.

In accordance with another aspect, the venting means vents a primary nozzle for increasing its reach and supplying the vented flow to a second nozzle for intermediate area coverage.

BRIEF DESCRIPTION OF THE DRAWING

The above and other objects and advantages of the present invention will become apparent from the following description when read in conjunction with the drawings wherein.

DETAILED DESCRIPTION OF A PREFERRED EMBODIMENT

Figure 1:
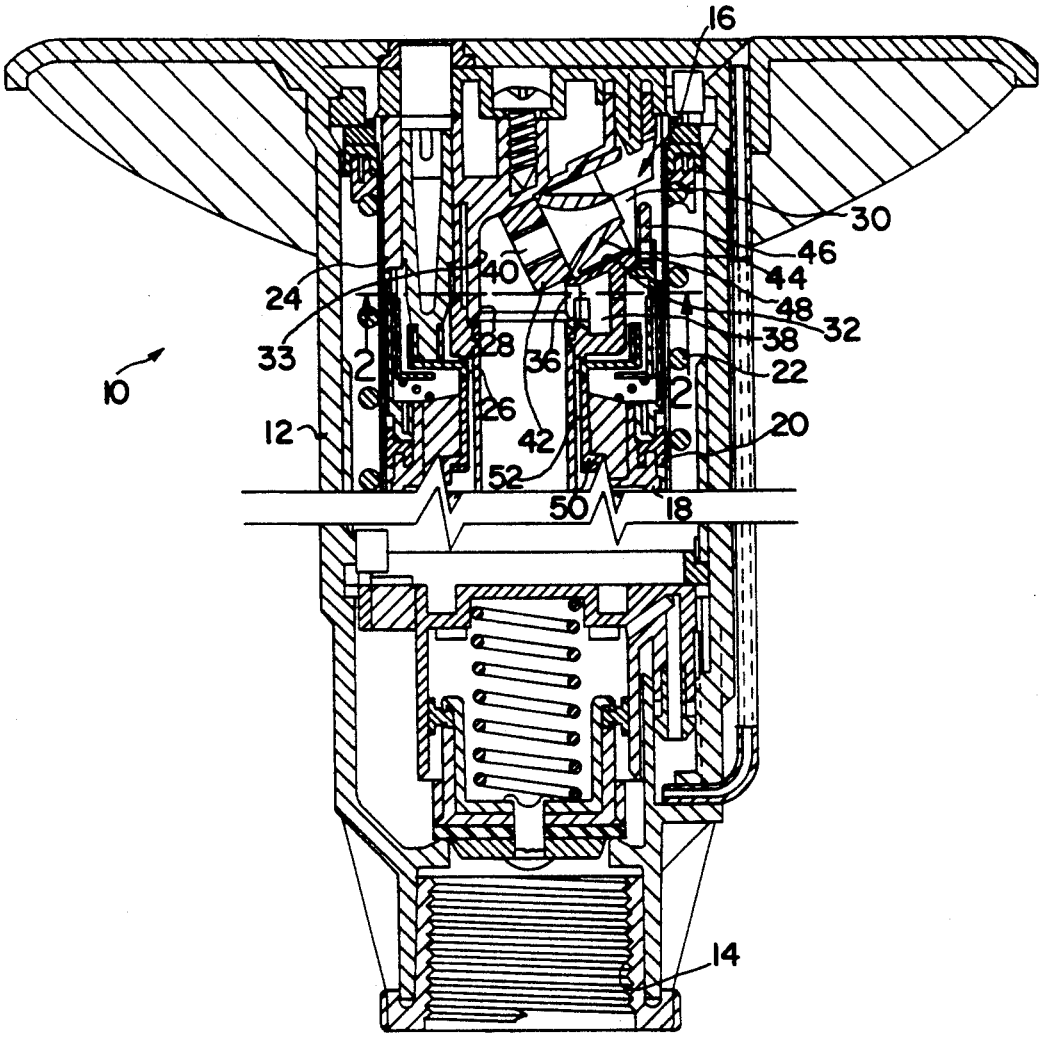
FIG. 1 is a side elevation view in section of a typical sprinkler unit showing a preferred embodiment of the invention.

Referring now to the drawings, particularly FIG. 1, there is illustrated a sprinkler unit of the rotary type embodying a preferred embodiment of the present invention. The sprinkler unit, in accordance with the invention, is designated generally by the numeral 10 and comprises an elongated cylindrical main body 12 having an inlet 14, with means for threadable attachment to a source of pressurized water, and an outlet end from which a nozzle, designated generally at 16, projects for distributing water. Details of the drive turbine and gearing at the center portion of the sprinkler unit are omitted for simplicity as they form no part of the present invention. Examples of suitable drives may be found in the aforementioned Hunter patent as well as in Hunter U.S. Pat. No. 4,568,024, granted Feb. 4, 1986.

An inner housing 18 and a tubular sleeve 20 are reciprocably mounted within the housing 12, and include radial flanges (not shown) at the lower end thereof engaged by return springs 22, (only one of which 22 is shown), biased against the radial flanges, and an upper retainer ring and retainer cap of the housing 12 to bias the inner housing and sleeve to the retracted position. The illustrated sprinkler unit is a pop-up type having a rotatable nozzle 16 that may oscillate or rotate in alternate directions.

A turbine and reduction drive assembly (not shown) is mounted in the inner housing for driving the nozzle. The inner housing 18 is mounted within the outer housing and extends into the protective sleeve 20 for reciprocable movement therewith for protective extension and retraction through a layer of soil. Reference is made to Hunter U.S. Pat. No. 4,796,809, which is incorporated herein as though fully set forth for further details of retractable housing construction and drive turbine and gearing.

Figure 2:
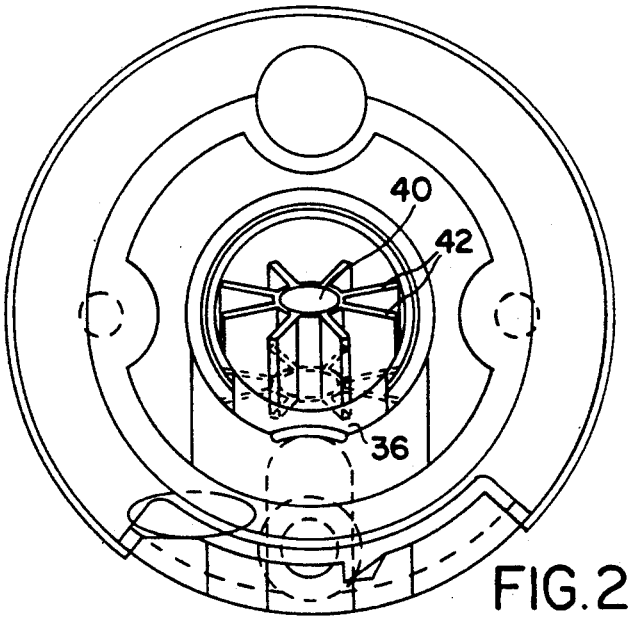
FIG. 2 is a view taken generally on line 2—2 of FIG. 1.
Figure 3:
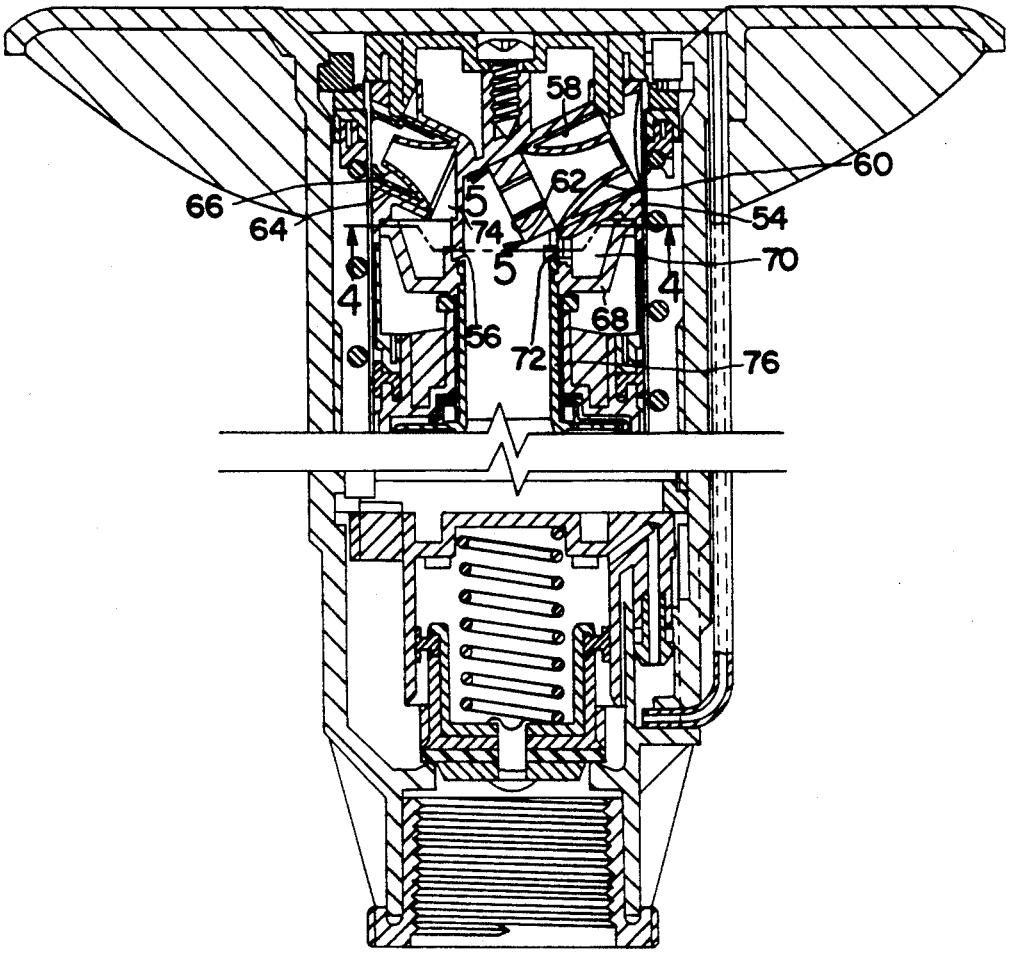
FIG. 3 is a view like FIG. 1 of an alternate embodiment of the invention.

The nozzle unit as illustrated in FIGS. 1 and 2 comprises a nozzle defined by a complex body of opposing upper shell 24 and lower shell 26. The two shells are separately molded for convenience of molding and fitted together, defining a body having an elongated water passageway connecting between a generally circular inlet opening 28 at one end, and a generally circular outlet opening 30 at the other end. The passageway has generally cylindrical inlet section 33 for extending vertically, and a generally cylindrical outlet section 32 extending outwardly at an angle to the inlet section.

The two sections 33 and 32 intersect at a fairly sharp curve or elbow, with the outlet section extending outwardly at about 25 degrees to the horizon.

The nozzle is constructed to take a generally vertical axially flowing stream of water and change its direction, and direct it outward at an angle of on the order of about 25 degrees or so relative to the horizon or horizontal. The nozzle is constructed to provide a highly efficient flow of the water by substantially reducing turbulence in the water flowing therethrough as it makes its turn in the curve in changing direction from the inlet section to the outlet section.

An important feature that has been found to increase the throw or reach of the nozzle is the provision of a vent or bleed port 36 at the inside of the curve. The vent port 36 opens into a chamber 38, which in this instance is closed and encircles the passageway. The bleed or vent port in the illustrated embodiment is formed in the wall of the inlet section extending to the inside corner. It has a width, as shown in FIG. 2, of on the order of about one-half the diameter of the flow channel. However, it may extend up to the full diameter. This provision of a vent port at the inside corner has been found to increase the reach of the nozzle by about forty percent. In one nozzle, a vent port increased the reach from sixty-seven feet to eighty-one feet, a forty percent increase.

Figure 5:
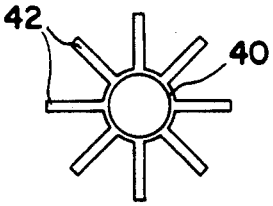
FIG. 5 is a view taken on line 5—5 of FIG. 3.

The efficiency of the flow is also increased or enhanced by a channeling device, as shown in FIGS. 1, 2 and 5 comprising a central tube 40, with a plurality of radial fins 42 extending outwardly from the outer surface thereof. The channeling device is positioned at the curve and predominately in the outlet section. It separates the flow of water at the curve into a plurality of small channels and reduces the turbulence in the water as it changes direction. The combination of the bleed or vent port and channeling produces a highly efficient flow that increases the reach or distance of the stream which flows from the nozzle.

A converging orifice insert 44 is positioned at the outlet end of the outlet section of the passageway. This overall nozzle assembly has been found to be highly efficient and forms a relatively compact nozzle assembly capable of increasing the reach beyond that of the conventional nozzle. This construction with a vent port at the inside corner of the curve from the inlet to the outlet sections was discovered by us to increase the efficiency of the nozzle assembly. It is unclear how the vent or bleed port assembly functions with a closed chamber as disclosed herein. However, its effect is clear in that it increases the reach or throw of a stream of a given volume and pressure issuing from the nozzle. It has also been found to be effective with an open chamber as will be described with respect to an alternate embodiment.

The distribution of the water issuing from the orifice may be enhanced by interrupting means, which in this embodiment comprises a pin 46 mounted on an annular band 48 and extends into the lower portion of the stream for breaking it up and causing distribution thereof in an intermediate area between the sprinkler unit and its outermost reach. The interruptor pin may be of an assembly similar to that disclosed in Hunter's prior U.S. Pat. Nos. 4,834,289 and 4,836,450, which are incorporated herein by reference. The pins may be designed to intermittently extend into the stream or to continuously remain within the stream. Alternatives are provided in the prior Hunter patents.

The nozzle body assembly, as above described in the illustrated embodiment, is mounted in a suitable manner on the upper end of a rotatable hollow shaft 50, which is journaled in a cylindrical bore 52 in the internal housing 18. The hollow shaft 50 provides a water flow passage from the inlet of the housing into the inlet of the nozzle assembly. The shaft 50 may be rotated in any suitable manner, such as continuously full circle or intermittently in alternate directions. Suitable driving mechanisms, such as turbines, together with turbine gearing assemblies, are disclosed in prior Hunter patents as mentioned above, which are incorporated herein by reference as though fully set forth. Any such suitable drive mechanisms may be utilized herein. Various seals and other structures illustrated in the drawing and not described herein are believed to be well within the skill of the those in the art, particularly when taken in conjunction with the prior Hunter patents. It is not believed necessary to describe these in order to enable one of ordinary skill in the art to practice the invention, or to disclose the best mode contemplated by us at this time.

Figure 4:
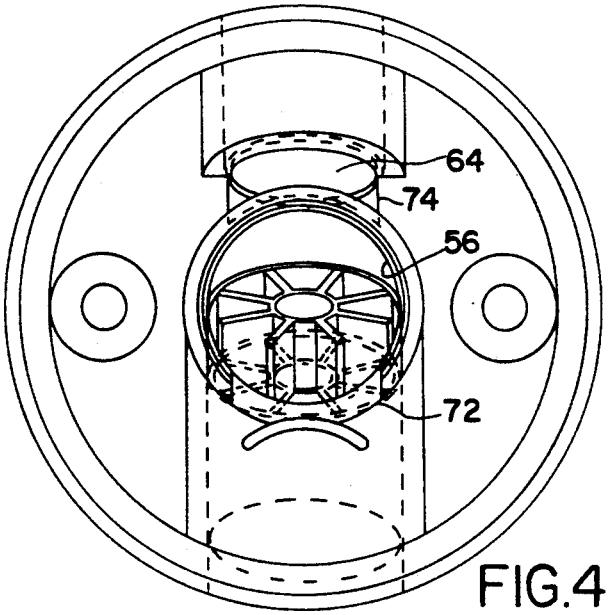
FIG. 4 is a view like FIG. 2 taken on line 4—4 of FIG. 3.

Referring to FIG. 4, a side elevation view in section of an alternate embodiment of the invention is illustrated. In this embodiment, an upper housing 54 somewhat similar to the previous embodiment is illustrated having a passageway formed by an inlet section 56 and an outlet section 58 joining at a sharp (small radius of curvature) curve or corner as in the previous embodiment. A converging orifice assembly 60 is mounted in the outer end of the outlet section as in the previous embodiment. Similarly, a channeling device 62 is disposed in the inlet to the outlet section adjacent the corner or curve of the passageway of the outlet section.

In this embodiment, a second or auxiliary outlet 64 is provided directly opposite the primary nozzle outlet 58. The second outlet in the illustrated embodiment is one-hundred eighty degrees from the first nozzle or orifice at about the same twenty-five degree angle. An orifice of the converging type 66 is disposed within the outlet section of the auxiliary outlet. The upper housing 54 is mated with a lower housing 68 having a somewhat bowl configuration cooperating with the lower portion of the housing 54 for forming an annular chamber or passage 70 into which a vent or bleed port 72 communicates from the inside curve of the primary passageway. The annular passageway or chamber 70 communicates by means of an inlet passage 74, with the second or auxiliary outlet 64. The overall body assembly is mounted in a suitable manner on the upper end of a hollow or tubular drive shaft 76 driven as in the previous embodiment. In this embodiment, the primary nozzle outlet and orifice 60 may be designed to reach the maximum distance, and the auxiliary outlet or orifice 66 may be designed to reach an intermediate position. Similarly, either one or both of these outlet orifices may be provided with interruption means as previously described to further enhance distribution of the water.

In operation of this illustrated embodiment, as water is turned on and flows through the housing and along the passageway 56, the main stream as it engages the channeling means 62 is broken into the various channels, and separately directed into the outlet orifice 60 where it converges and exits therefrom in an efficient manner. An inside portion of the main body of water flowing along the flow passage exits the vent port 72, and flows along the annular chamber or passage 70 via inlet 74 to the outlet orifice 66 and exits therefrom for distribution in an area selected. The venting of a portion of the stream by vent means 72 has the effect of improving the reach of the stream exiting from the primary orifice 60. As previously explained, it is uncertain why such improvement exists in the flow from the orifices.

While I have illustrated and described my invention by means of specific embodiments, it should be understood that numerous changes and modifications may be made therein without departing from the spirit and scope of the invention as defined in the appended claims. I further assert and sincerely believe that the above specification contains a written description of the invention and the manner and process of making and using it, in such full, clear, concise, and exact terms as to enable any person skilled in the art to which it pertains, or with which it is most nearly concerned, to make and use the same, and further that it sets forth the best mode contemplated by me for carrying out the invention.

I claim:

1. A sprinkler nozzle for distributing water from a source over an area of terrain comprising:

a body defining a passage having an inlet section connected by a curve to an outlet section extending at an angle to said inlet section; and vent means in said passage at the inside of said curve communicating with an annular chamber surrounding said inlet section for enhancing the reach of said nozzle.

2. A sprinkler nozzle according to claim 1 wherein said annular chamber is a closed chamber.

3. A sprinkler nozzle according to claim 1 wherein said annular chamber communicates to a second nozzle.

4. A sprinkler unit according to claim 3 wherein said second nozzle is disposed at an angle about the axis of the inlet section relative to the outlet section.

5. A sprinkler nozzle according to claim 1 wherein:

said inlet section is a substantially straight section extending along an axis; and said outlet section is a substantially straight section extending at an angle of about twenty-five degrees to the horizon.

6. A sprinkler nozzle according to claim 5 wherein:

said outlet section includes channeling means for confining a stream of water therein to a plurality of channels around a central axis thereof.

7. A sprinkler nozzle according to claim 6 wherein:

said channeling means comprises a tubular central section having a plurality of fins extending radially outwardly therefrom.

8. A sprinkler nozzle according to claim 5 wherein said annular chamber is a closed chamber.

9. A sprinkler nozzle according to claim 5 wherein said annular chamber communicates to a second nozzle.

10. A sprinkler unit having nozzle means for maximizing the throw of a given quantity of water therefrom, comprising:

a housing having an inlet and an outlet and passage means for connecting said inlet to a source of water;

a nozzle mounted at said outlet for distributing a stream of water outward from said housing;

said nozzle having a passage with a substantially straight nozzle inlet section for receiving water from said source, a substantially straight nozzle outlet section extending at an angle to said nozzle inlet section for directing a stream of water outward over an adjacent area, a curve in said passage connecting said nozzle inlet section to said nozzle outlet section for conveying water thereto, and vent means in said passage at the inside of the curve communicating with an annular chamber surrounding said inlet section for extending the reach of said nozzle.

11. A sprinkler unit according to claim 10 wherein said annular chamber is a closed chamber.

12. A sprinkler unit according to claim 11 wherein:

said inlet section is a substantially straight section extending along an axis; and said outlet section is a substantially straight section extending at an angle of about twenty-five degrees to said inlet section.

13. A sprinkler unit according to claim 12 wherein said outlet section includes channeling means for confining a stream of water therein to a plurality of channels around a central axis thereof.

14. A sprinkler unit according to claim 13 wherein said channeling means comprises a tubular central section having a plurality of fins extending radially outwardly therefrom.

15. A sprinkler unit according to claim 10 wherein said annular chamber communicates to a second nozzle.

16. A sprinkler unit according to claim 15 wherein said second nozzle is disposed at an angle about the axis of the inlet section relative to the outlet section.

17. A sprinkler unit having nozzle means for maximizing the throw of a given quantity of water therefrom, comprising:

a housing having an inlet and an outlet and passage means for connecting said inlet to a source of water;

a nozzle mounted at said outlet for distributing a stream of water outward from said housing;

said nozzle having a passage with a substantially straight nozzle inlet section extending along an axis for receiving water from said source, a substantially straight nozzle outlet section extending at an angle of about twenty-five degrees to the horizontal for directing a stream of water outward over an adjacent area, a curve in said passage connecting said nozzle inlet section to said nozzle outlet section for conveying water thereto; and vent means in said passage at the inside of the curve communicating with a closed annular chamber surrounding said inlet section for extending the reach of said nozzle.

18. A sprinkler unit according to claim 17 wherein said outlet section includes channeling means for confining a stream of water therein to a plurality of channels around a central axis thereof.

19. A sprinkler unit according to claim 18 wherein said channeling means comprises a tubular central section having a plurality of fins extending radially outwardly therefrom.

* * * * *